US010266244B2

(12) United States Patent
Bergmann et al.

(10) Patent No.: US 10,266,244 B2
(45) Date of Patent: Apr. 23, 2019

(54) ELECTRIC BOAT DRIVE

(71) Applicant: Torqeedo GmbH, Gilching (DE)

(72) Inventors: Lothar Bergmann, Gilching (DE); Frank Despineux, Gilching (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 15/594,169

(22) Filed: May 12, 2017

(65) Prior Publication Data

US 2017/0327198 A1 Nov. 16, 2017

(30) Foreign Application Priority Data

May 13, 2016 (EP) ..... 16001098

(51) Int. Cl.

| | |
|---|---|
| ***B63H 20/14*** | (2006.01) |
| ***B63H 20/20*** | (2006.01) |
| ***B63H 20/00*** | (2006.01) |
| ***B63H 21/21*** | (2006.01) |
| *B63H 25/02* | (2006.01) |

(52) U.S. Cl.

CPC ..... *B63H 20/14* (2013.01); *B63H 20/007* (2013.01); *B63H 20/20* (2013.01); *B63H 21/213* (2013.01); *B63B 2755/00* (2013.01); *B63H 2025/024* (2013.01)

(58) Field of Classification Search

CPC ..... B63H 5/125; B63H 21/30; B63H 21/17; B63H 21/24; B63H 2005/075; B63H 2025/425; B63H 2021/307; B63H 2005/1258

See application file for complete search history.

(56) References Cited

U.S. PATENT DOCUMENTS

| | | | | |
|---|---|---|---|---|
| 7,594,833 | B2 * | 9/2009 | Oishi | B63H 20/10 440/1 |
| 2006/0046585 | A1 | 3/2006 | Harada et al. | |
| 2006/0189226 | A1 | 8/2006 | Blair | |
| 2010/0326760 | A1 * | 12/2010 | Dugas | B60L 7/16 180/335 |
| 2016/0090165 | A1 | 3/2016 | Suzuki et al. | |

FOREIGN PATENT DOCUMENTS

| | | | |
|---|---|---|---|
| CN | 2727048 | Y | 9/2005 |
| CN | 101489863 | A | 7/2009 |
| CN | 202138529 | U | 2/2012 |
| EP | 1 961 656 | B1 | 12/2011 |
| WO | WO 01/51353 | A1 | 7/2001 |

OTHER PUBLICATIONS

Chinese Office Action issued in Chinese counterpart application No. 201710338933.5 dated Jul. 24, 2018, with partial English translation (Eight (8) pages).

* cited by examiner

*Primary Examiner* — Anthony D Wiest
(74) *Attorney, Agent, or Firm* — Crowell & Moring LLP

(57) ABSTRACT

A control device for controlling an electric motor. The control device includes a twist grip that is rotatably mounted on a carrier such that the twist grip is user-twistable in a first direction from a neutral position to a first operating position, and in a second direction from the neutral position to a second operating position. The control device further includes a force element for producing a return force. The force element operatively couples to the twist grip via a force transmission element and at least one deflection element such that the force element applies the return force to the twist grip thereby twisting the twist grip to the neutral position.

14 Claims, 1 Drawing Sheet

ELECTRIC BOAT DRIVE

This application claims the priority of European Patent Document No. EP 16 001 098.9, filed May 13, 2016, the disclosure of which is expressly incorporated by reference herein.

BACKGROUND AND SUMMARY OF THE INVENTION

The disclosure relates to a control device for controlling an electric motor, comprising a twist grip and a carrier on which the twist grip is rotatably mounted, wherein the twist grip can be brought into a first operating position by being turned from a neutral position in a first direction, and wherein the twist grip can be brought into a second operating position by being turned from the neutral position in a second direction opposed to the first direction.

Outboard motors for boats are often controlled by means of a tiller attached to the outboard motor. By means of a control device which is disposed on the tiller and comprises a twist grip, the motor can be accelerated and the propeller of the outboard motor can be set in rotation.

In outboard motors with combustion motors, the engagement of forward or reverse gears takes place by means of a selector switch for forward and reverse gears. The control device serves only to adjust speed, and can thus be turned in only one direction from the initial neutral position.

The control device is usually provided with a spring return mechanism, so that the throttle automatically returns to the idle setting when the boat driver releases the control device. For this purpose a simple return spring, which brings the twist grip back to the neutral position, is normally incorporated in the control device.

In the case of an outboard motor with an electric motor, the selector switch for forward and reverse gears can be dispensed with. The propeller's direction of rotation can be governed via the direction of the current. Thus in the case of an electric outboard motor the functions "direction of travel" and "speed" can be integrated in the control device. The direction in which the twist grip of the control device is turned governs the direction of travel, and the angle through which it is turned governs the speed. For reverse motion, the twist grip of the control device is simply turned in the opposite direction.

With an electric drive, it is again necessary for the twist grip of the control device to return to the neutral position when the boat driver releases the control device, irrespective of the direction in which the twist grip has been turned. The known spring return mechanism of control devices, as used in combustion motors, cannot be used in this case, since it acts in only one direction.

An object of the present invention is therefore to provide a control device with a twist grip that can be turned in both directions from an initial neutral position and is provided with an automatic return which, when the twist grip is released, turns the twist grip back to the neutral position.

The disclosure relates to a control device for controlling an electric motor. The control device comprises a twist grip and a carrier on which the twist grip is rotatably mounted. The twist grip can be turned in both directions from an initial neutral position, enabling the twist grip to be brought into a first operating position by being turned in a first direction, and into a second operating position by being turned in the opposite direction.

The disclosure further comprises an automatic return device. For this purpose a force element, a force transmission element and a deflection element are provided. The force element acts on the twist grip via the force transmission element and the deflection element, and applies a force to the twist grip. By this means the twist grip is turned back to the neutral position, irrespective of whether the twist grip is in the first operating position or the second operating position.

The term "force element" is to be understood as referring to an element that applies a return force for returning the twist grip. The force element can be designed as an electrical, magnetic, pneumatic, hydraulic or mechanical element. This means that the return force can be applied by electrical, magnetic, pneumatic, hydraulic or mechanical means.

In at least one embodiment, the force element is designed as a spring element which is elastically deformable. When subject to a force, the spring element deforms, and when the force exerted on it ceases the spring element returns to its original shape.

The force element is preferably elastically deformed by turning the twist grip of the control device, and hence by changing the rotation angle between the twist grip and the carrier. When the boat driver releases the twist grip, the force exerted on the force element ceases and the force element returns to its original shape. By this means the twist grip is turned, relative to the carrier, back to its neutral position.

In at least one embodiment, the force element is designed as a helical spring. The force element consists of a spring wire wound in a cylindrical, conical or barrel shape. The main direction of loading is along the longitudinal axis of the helical spring. In this case the helical spring can be designed as a tension spring or a compression spring. When loaded, i.e. when the twist grip is turned, the spring is either pulled apart or pressed together. The disclosure is not however restricted to helical springs. It is also possible to use other force elements, such as for example spiral springs.

A metallic force element or spring element is preferably used. It is however also entirely possible to use spring elements formed from another elastically deformable material, such as for example rubber springs.

The force transmission element serves to transmit to the twist grip the return force exerted by the force element, and turn the twist grip back to its neutral position. In at least one embodiment, the force transmission element is designed as a pull cable or linkage. Depending on the type of force element, either a force transmission element that transmits tensile forces or a force transmission element that transmits compressive forces is used. In this respect the combination of helical spring and pull cable has proved to be favorable.

The twist grip according to the invention must return automatically to the neutral position when it is released, irrespective of the direction in which it was turned. For this purpose, according to the invention a deflection element is used, which deflects the force transmission element such that it always acts on the force element in the same direction, independently of the direction in which the twist grip is turned. As deflection element, for example a roller, a sliding guide and/or a lever is used.

This is explained by means of an example. For the sake of example, a pull cable or pull wire is provided on the twist grip, and a deflection element is provided on the carrier. The pull cable or pull wire runs over the deflection element and connects the twist grip and a spring element which serves as a force element and which is attached to a fixed point on the carrier. When the twist grip is in the neutral position, the length of the pull cable or pull wire together with the spring element is at a minimum. When the twist grip is deflected relative to the carrier, the spring element is elongated. The defection element is arranged such that the spring element is always elongated in the same direction, irrespective of the direction in which the twist grip is turned. This means that when the twist grip is released, the direction in which the spring element recovers its original form, and thereby returns the twist grip to the neutral position, is always the same.

In at least one embodiment, two or more of the elements in the group comprising the force element, force transmission element and defection element are integrated in a single component. For example, in place of a spring as force element and a pull cable as force transmission element, it is possible to use a rubber cord which combines the functions of the force element and the force transmission element.

In at least one embodiment, the carrier is at least in part designed as a hollow body, and the force element is disposed in the interior of the carrier. This arrangement has the advantage that the force element, defection element and force transmission element are protected from external influences. This is particularly advantageous when the invention is used on a boat, since in this case the environmental influences are especially large. If the control device is for example used to control an outboard motor of a boat, the control device is exposed for example to water splashes, which can lead to corrosion and associated restrictions on functioning.

According at least one embodiment, the force element is attached on the outside of the carrier. This has the advantage that the return mechanism comprising the force element, force transmission element and defection element is easily accessible and easy to maintain.

At least one embodiment is advantageously used to control an electric motor that is part of an outboard drive for a boat.

A preferred area of application of the invention is electric outboard drives, wherein the electric motor drives a propeller. In this case the control device serves to regulate the speed and select the direction of travel. For forward and reverse travel, the twist grip can be turned in different directions from the initial neutral position. The first and second operating positions thereby designate forwards and reverse travel respectively.

The invention and further aspects of the invention are explained below in greater detail using the schematic drawings. Other features and advantages will become apparent from the following more detailed description, taken in conjunction with the accompanying drawings, which illustrate, by way of example, the principles of the presently described embodiments.

DETAILED DESCRIPTION OF THE DRAWINGS

Figure 1:
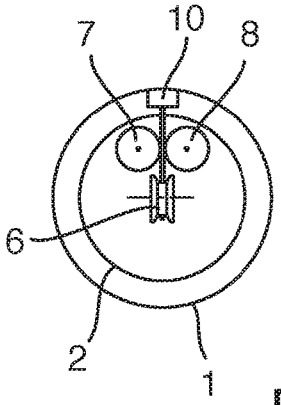
FIG. 1 schematically show a control device according to at least one embodiment.
Figure 2:
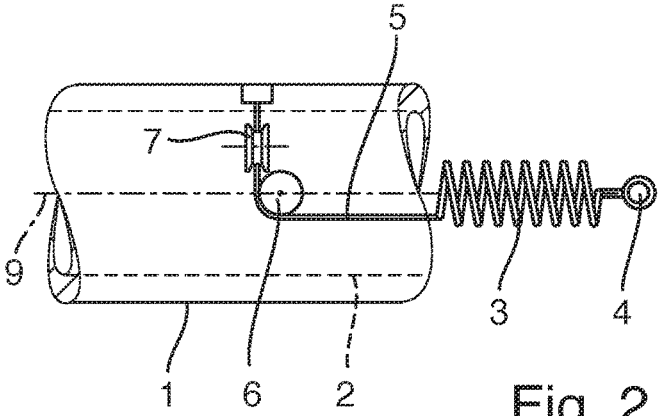
FIG. 2 schematically show the control device of FIG. 1.

The above described drawing figures illustrate the described invention in at least one embodiment, which is further defined in detail in the following description. Those having ordinary skill in the art may be able to make alterations and modifications to what is described herein without departing from its spirit and scope. While the disclosure is susceptible of embodiment in many different forms, there is shown in the drawings and will herein be described in detail at least one embodiment of the invention with the understanding that the present disclosure is to be considered as an exemplification of the principles of the invention and is not intended to limit the broad aspect of the disclosure to the embodiment illustrated. Therefore, it should be understood that what is illustrated is set forth only for the purposes of example and should not be taken as a limitation on the scope of the present disclosure FIGS. 1 and 2 show schematically a control device for controlling an electric outboard motor. The control device has a twist grip 1, which is rotatably mounted on the tube 2 that serves as a tiller. In FIG. 1, twist grip 1 is shown in the neutral position. By turning the twist grip 1, the power supplied to the electric outboard motor and the speed of rotation of the propeller of the outboard motor are regulated, via a system that is not shown here. From the initial neutral position of the twist grip 1, turning the twist grip 1 in one direction causes rotation of the propeller in one direction, and turning the twist grip 1 in the other direction correspondingly causes rotation of the propeller in the other direction. In this manner the boat, which is driven by the outboard motor, is set in forward motion by turning the twist grip 1 clockwise (FIG. 1), and set in reverse motion by turning counter-clockwise.

In the interior of the tube 2, a return spring 3 is attached at one end to a hook 4 or another fixed point (fixed relative to the tube 2). At the other end of the return spring 3 a pull cable 5 is attached. The pull cable 5 can be for example a natural fiber or synthetic fiber cord, a wire cable, or a comparable elongated element which is suitable for transmitting the tensile forces.

In the interior of the tube 2, a first deflection roller 6 is further provided. The axis of rotation of the deflection roller 6 is perpendicular to the axis of symmetry 9 of the tube 2. The first deflection roller 6 is designed as a fixed roller. This means that its position relative to the tube 2 is fixed, and does not change during use. In place of a deflection roller, a non-rotatable deflection element can also be used. This does not affect the principle of the invention, but the losses due to friction are somewhat higher.

Two further deflection rollers 7, 8 are also fixed in the interior of the tube 2. The axes of rotation of both deflection rollers 7, 8 are aligned in the direction of the axis of symmetry 9. The two deflection rollers 7, 8 are disposed at the same level, and almost touch each other, but with sufficient space remaining between the deflection rollers 7, 8 for the pull cable 5 to be guided between the deflection rollers 7, 8. The two deflection rollers 7, 8 can also be replaced with fixed deflection elements.

The pull cable 5 runs from the return spring 3 to the first deflection roller 6. In FIG. 2, the return spring 3 and the first deflection roller 6 are disposed such that the pull cable runs between the return spring 3 and the first deflection roller 6 substantially in the axial direction 9. The hook or fixed point 4 and the first deflection roller 6 can, however, also be otherwise disposed relative to each other, in such a manner that the pull cable 5 does not run between the return spring 3 and the first deflection roller 6 parallel to the axis of symmetry 9, but at an angle to it.

The pull cable 5 is deflected by the first deflection roller 6 to the second deflection rollers 7, 8. Preferably, the first deflection roller 6 and the two deflection rollers 7, 8 are disposed relative to each other such that the pull cable 5 is deflected by 90°. The other end of the pull cable 5 is attached to an attachment device 10 of the twist grip 1.

In the neutral position of the twist grip 1, the return spring 3 and the pull cable 5 are only slightly tensioned. If the twist grip 1 is turned out of the neutral position, the attachment device 10 moves away from the two deflection rollers 7 and 8, and this transmit a tensile force via the pull cable 5 to the return spring 3. Due to this, the return spring 3 is pulled apart and further tensioned. If the boat driver then releases the twist grip 1, the twist grip 1 is turned by the spring force of the return spring 3, via the pull cable 5, back to the neutral position.

Irrespective of the direction in which the twist grip 1 is turned, i.e. clockwise or counter-clockwise, after the twist grip 1 is released it is brought back by the return spring 3 to the neutral position. Depending on the direction in which the twist grip 1 is turned, the pull cable 5 runs over the deflection roller 7 or over the deflection roller 8.

Figure 3:
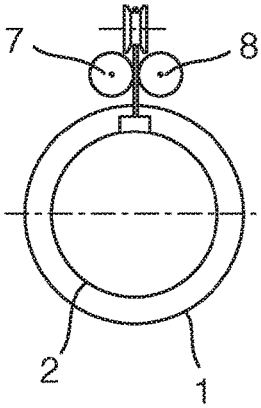
FIG. 3 schematically show a control device according to at least one other embodiment.
Figure 4:
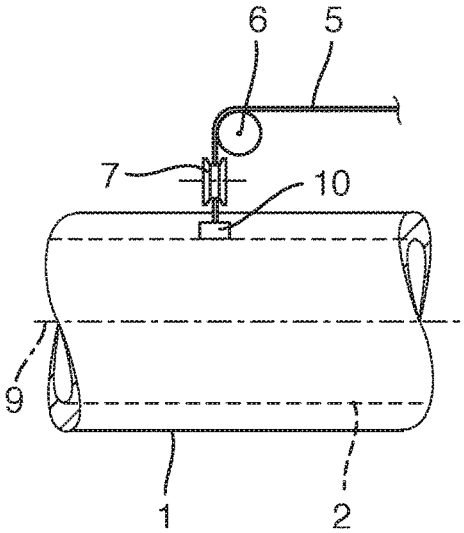
FIG. 4 schematically show the control device of FIG. 3.

FIGS. 3 and 4 show a further embodiment of the invention. The same elements are designated with the same reference numbers in all figures. The embodiment according to FIGS. 3 and 4 substantially corresponds to the embodiment shown in FIGS. 1 and 2. The mechanism for turning back the twist grip 1 is, however, disposed outside the tube 2 rather than inside the tube 2.

The enablements described in detail above are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the claimed subject matter is what is intended to be patented.

What is claimed is:

1. A control device for controlling an electric motor, the control device comprising:

a twist grip rotatably mounted on a carrier such that the twist grip is user-twistable in a first direction from a neutral position to a first operating position, and in a second direction from the neutral position to a second operating position; and a force element for producing a return force, the force element operatively coupled to the twist grip via a force transmission element and at least one deflection element such that the force element applies the return force to the twist grip thereby twisting the twist grip to the neutral position from both the first position and the second position.

2. The control device of claim 1, wherein two or more of: the force element, force transmission element and defection element, are integrated in a single component.

3. The control device of claim 1, wherein the force element is a spring element.

4. The control device of claim 1, wherein the force transmission element is a pull cable or linkage.

5. The control device of claim 1, wherein the deflection element comprises at least one of: a roller, a sliding guide and a lever.

6. The control device of claim 1, wherein the carrier is at least in part a hollow body, and the force element is disposed in the interior of the hollow body.

7. The control device of claim 1, wherein the force element is attached on the outside of the carrier.

8. The control device of claim 1, wherein the electric motor is part of an outboard drive for a boat.

9. The control device of claim 8, wherein the outboard drive has a propeller, and the propeller rotates in different directions in the first and the second operating position.

10. The control device of claim 8, wherein the outboard drive has a tiller, and a portion of the tiller serves a carrier.

11. The control device of claim 8, wherein the outboard drive is an outboard motor.

12. A control device for controlling an electric motor, comprising:

a twist grip and a carrier on which the twist grip is rotatably mounted, wherein the twist grip can be brought into a first operating position by being turned from a neutral position in a first direction, and wherein the twist grip can be brought into a second operating position by being turned from the neutral position in a second direction opposed to the first direction; and a force element for producing a return force, wherein the force element is in operative connection, via a force transmission element and a deflection element, with the twist grip, so that the force element applies a force to the twist grip which rotates the twist grip out of both the first operating position and the second operating position back into the neutral position, wherein the electric motor is part of an outboard drive for a boat, wherein the electric motor drives a propeller, wherein the control device regulates the speed and selects the direction of travel, and wherein the first and second operating positions designate forwards and reverse directions of travel, respectively.

13. A control device for controlling an electric motor, comprising:

a twist grip and a carrier on which the twist grip is rotatably mounted, wherein the twist grip can be brought into a first operating position by being turned from a neutral position in a first direction, and wherein the twist grip can be brought into a second operating position by being turned from the neutral position in a second direction opposed to the first direction; and a force element for producing a return force, wherein the force element is in operative connection, via a force transmission element and a deflection element, with the twist grip, so that the force element applies a force to the twist grip which rotates the twist grip out of both the first operating position and the second operating position back into the neutral position, wherein the force transmission element is a pull cable or linkage.

14. A control device for controlling an electric motor, comprising:

a twist grip and a carrier on which the twist grip is rotatably mounted, wherein the twist grip can be brought into a first operating position by being turned from a neutral position in a first direction, and wherein the twist grip can be brought into a second operating position by being turned from the neutral position in a second direction opposed to the first direction; and a force element for producing a return force, wherein the force element is in operative connection, via a force transmission element and a deflection element, with the twist grip, so that the force element applies a force to the twist grip which rotates the twist grip out of both the first operating position and the second operating position back into the neutral position, wherein the deflection element comprises a roller, a sliding guide and/or a lever.

* * * * *